US010785551B2

(12) United States Patent
Graff et al.

(10) Patent No.: US 10,785,551 B2
(45) Date of Patent: Sep. 22, 2020

(54) PORTABLE LOUDSPEAKER

(71) Applicant: Bose Corporation, Framingham, MA (US)

(72) Inventors: Allen T. Graff, Sutton, MA (US); Roman N. Litovsky, Newton, MA (US); Bojan Rip, Newton, MA (US); Jason D. Silver, Framingham, MA (US); Donna Marie Sullivan, Millbury, MA (US); Chester Smith Williams, Lexington, MA (US); Zhen Xu, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/910,591

(22) Filed: Mar. 2, 2018

(65) Prior Publication Data

US 2018/0192173 A1 Jul. 5, 2018

Related U.S. Application Data

(63) Continuation of application No. 13/909,071, filed on Jun. 3, 2013, now abandoned.

(51) Int. Cl.

| | |
|---|---|
| ***H04R 1/02*** | (2006.01) |
| ***H04R 1/28*** | (2006.01) |
| *H04R 5/02* | (2006.01) |

(52) U.S. Cl.

CPC ..... *H04R 1/025* (2013.01); *H04R 1/02* (2013.01); *H04R 1/2834* (2013.01); *H04R 5/02* (2013.01)

(58) Field of Classification Search

CPC ..... H04R 1/025; H04R 1/02; H04R 1/2834; H04R 1/283; H04R 5/02; H04R 1/023; H04R 1/2803; H04R 1/2869; H04R 1/2873; H04R 1/2876; H04R 1/288; H04R 1/2823; H04R 1/2826; H04R 1/2849; H04R 7/18; H04R 7/20; H04R 7/22; H04R 2207/00; H04R 2207/021; H04R 2307/207

(Continued)

(56) References Cited

U.S. PATENT DOCUMENTS

| | | | |
|---|---|---|---|
| 3,669,215 | A | 6/1972 | Kikuchi et al. |
| 4,131,180 | A | 12/1978 | Maeda |

(Continued)

FOREIGN PATENT DOCUMENTS

| | | | |
|---|---|---|---|
| CN | 101023703 | A | 8/2007 |
| CN | 202145681 | U | 2/2012 |

(Continued)

OTHER PUBLICATIONS

CN Office Action dated Jan. 19, 2018 for CN Appln. 201480031677.X.

(Continued)

*Primary Examiner* — Jason R Kurr

(57) ABSTRACT

A loudspeaker includes a first electro-acoustic driver that creates sound waves when operated, and a housing. A first baffle is coupled to the housing and the first electro-acoustic driver. A first speaker grille covers the first electro-acoustic driver. A first gasket is disposed between the first baffle and the first speaker grille. The first gasket comprises a first set of energy directors to reduce buzzing between the first gasket and the first baffle.

26 Claims, 17 Drawing Sheets

(58) Field of Classification Search
USPC ..... 381/150, 337, 345, 351, 350, 184, 186, 381/386, 334
See application file for complete search history.

(56) References Cited

U.S. PATENT DOCUMENTS

| | | | | |
|---|---|---|---|---|
| 5,418,337 | A | 5/1995 | Schreiber | |
| 6,176,345 | B1 | 1/2001 | Perkins et al. | |
| 6,389,147 | B1 * | 5/2002 | Rush | H04R 5/02 381/302 |
| 7,032,708 | B2 * | 4/2006 | Popken | H04R 1/026 181/150 |
| 7,568,552 | B2 | 8/2009 | Litovsky et al. | |
| 8,160,286 | B2 | 4/2012 | Koike et al. | |
| 9,854,351 | B2 * | 12/2017 | Han | H04R 1/2834 |
| 2007/0201712 | A1 * | 8/2007 | Saiki | H04R 1/2834 381/186 |
| 2009/0139794 | A1 * | 6/2009 | Silver | H04R 7/20 181/171 |
| 2009/0324003 | A1 | 12/2009 | Stewart, Jr. et al. | |
| 2010/0111343 | A1 * | 5/2010 | Hsu | H04R 1/2834 381/335 |
| 2012/0039482 | A1 * | 2/2012 | Walsh | A63B 33/00 381/74 |
| 2012/0250924 | A1 * | 10/2012 | Nicholson | H04R 5/02 381/334 |
| 2012/0279796 | A1 * | 11/2012 | Lin | H04R 7/24 181/148 |

FOREIGN PATENT DOCUMENTS

| | | | |
|---|---|---|---|
| CN | 102438196 | A | 5/2012 |
| EP | 132781 | A1 | 2/1985 |
| JP | S59139791 | A | 8/1984 |
| JP | S61112495 | A | 5/1986 |
| JP | H09275596 | A | 10/1997 |
| JP | H11136792 | A | 5/1999 |
| JP | 2008187464 | A | 8/2008 |
| JP | 2009164676 | A | 7/2009 |
| JP | 2010259033 | A | 11/2010 |
| JP | 2010283491 | A | 12/2010 |
| JP | 2011-253195 | A | 12/2011 |
| WO | 9904597 | A2 | 1/1999 |
| WO | 200371831 | A1 | 8/2003 |

OTHER PUBLICATIONS

First Japanese Office Action dated Feb. 13, 2017 for Japanese Patent Application No. 2016-518379; Ref. No. H-13-144-JP.

* cited by examiner

PORTABLE LOUDSPEAKER

CROSS-REFERENCE TO RELATED APPLICATIONS

This application is a continuation of U.S. patent application Ser. No. 13/909,071, filed on Jun. 3, 2013, the disclosure of which is incorporated herein by reference in its entirety.

BACKGROUND

This disclosure relates to audio devices, and in particular to a portable loudspeaker.

U.S. Pat. No. 8,098,867 to Hampton et al. discloses an external acoustic chamber (220) for attachment to a mobile device (200). The external acoustic chamber (220) optimizes the audio performance of the mobile device (200) thus reducing the need for signal equalization and/or hardware to amplify the sound signal. The mobile device (200) includes a loudspeaker (205) and a first acoustic chamber (207) acoustically coupled to the loudspeaker (205). The external acoustic chamber (220) comprises at feast a second acoustic chamber (222) which penetrates the first acoustic chamber (207) adding volume to the first acoustic chamber (207). The combined greater volume reduces the dampening of loudspeaker (205) caused by the pressure in the first acoustic chamber (207). The result is an improvement in the frequency response of loudspeaker (205) approaching the natural frequency response of loudspeaker (205). The at least second acoustic chamber (222) is sized and shaped so that a first exterior surface portion of the acoustic chamber (220) covers or is flush with the battery (214) installed in the housing (201) of the mobile device (200). The first, exterior surface portion is substantially aligned with a second exterior surface portion enclosing the at least second acoustic chamber (222). The effect of the above disclosure is that the mobile device (200) is made substantially larger and heavier by the addition of the external acoustic chamber (220). Such an increase in size and weight is not desirable.

SUMMARY

In one aspect, a portable loudspeaker includes a first electro-acoustic driver which creates sound waves when operated; a housing having a first side to which the driver is secured, and a second side opposite the first side; a first passive radiator secured to the first side of the housing and a second passive radiator secured to the second side of the housing; and a unitary battery module removably secured to the housing in a region substantially between the first and second passive radiators, the battery providing electrical power to the driver, the sound waves from the driver being capable of acoustically energizing the first and second passive radiators.

Examples of the first aspect can include one or more the following features. A second electro-acoustic driver secured to the first side of the housing, wherein both the first and second drivers are located on either side of the first passive radiator. The battery module is disposed centrally between the first and second passive radiators. The loudspeaker is configured such that the maximum excursion of at least one of the passive radiators traverses substantially all of the distance between the at least one passive radiators and the battery. The first and second passive radiators comprise a surround for a diaphragm, the surround comprising first and second membrane sections, the first membrane section comprising a concave cross-section and the second membrane member comprising a convex cross-section. The first and second membrane sections of the first and second passive radiators alternative circumferentially along the diaphragm. At least one of the first and second passive radiators comprises a weight adhered to the diaphragm, the weight comprising a plurality of notches, which during a molding process to form the diaphragm fill with the molding material of the diaphragm. A first speaker grille covering the first electro-acoustic driver and the first passive radiator, a front speaker gasket attaching the first speaker grille to the housing; and a series of first energy directors disposed on a first side of the front speaker gasket and extending toward the housing, the first energy directors configured to minimize vibration between the first speaker grille and the housing. A series of second energy directors disposed on a second side of the front speaker gasket opposite the first side and extending toward the first speaker grille, the second energy directors configured to minimize vibration between the front speaker grille and the front speaker gasket. The portable loudspeaker may be configured for a wireless connection to an audio source. A vibrating surface of the first electro-acoustic driver and a vibrating surface of the first passive radiator are substantially coplanar. A vibrating surface of the first and second passive radiators are substantially parallel. The first and second passive radiators vibrate acoustically in phase with each other and mechanically out of phase with each other. The battery module is disposed substantially centrally between the first and second passive radiators. The housing comprises extruded aluminum having a first extruded opening to receive the first and second electro-acoustic drivers and the first passive radiator and a second extruded opening opposite the first extruded opening to receive the second passive radiator.

As described in a second aspect, a portable loudspeaker includes a first electroacoustic drivers which creates sound waves when operated; a housing having a first side to which the driver is secured, and a second side opposite the first side; a first passive radiator secured to the first side of the housing and a second passive radiator secured to the second side of the housing, the first and second passive radiators comprising first and second vibrating surfaces which are substantially coplanar; and a unitary battery module removably secured to the housing in a region substantially between the first and second passive radiators, the battery providing electrical power to the driver, the sound waves from the driver being capable of acoustically energizing the first and second passive radiators, Examples of the second aspect can include one or more the following features. The loudspeaker is configured such that the maximum excursion of at least one of the passive radiators traverses substantially all of the distance between the at least one passive radiators and the battery. A second electro-acoustic driver secured to the first side of the housing, wherein both the first and second drivers are located on either side of the first passive radiator. The battery module is disposed substantially centrally between the first and second passive radiators in the region within the housing. The first and second passive radiators vibrate acoustically in phase with each other and mechanically out of phase with each other.

According to a third aspect, a portable loudspeaker includes a housing having a first side to which the driver is secured, and a second side opposite the first side; a first passive radiator secured to the first side of the housing and a second passive radiator secured to the second side of the housing, the first and second passive radiators comprising first and second vibrating surfaces which are substantially coplanar; a first electro-acoustic driver located on a first side of the first passive radiator, a second electoacoustic driver located on a second side of the first radiator opposite the first side, the drivers create sound waves when operated; and a unitary battery module removably secured to the housing in a region substantially between the first and second passive radiators, the battery providing electrical power to the driver, the sound waves from the first and second drivers being capable of acoustically energizing the first and second passive radiators.

DETAILED DESCRIPTION

As unitary portable loudspeaker systems become increasingly compact, appreciable challenges arise in establishing a sufficiently large acoustic volume within the system and in providing adequate surface area on the housing of the system in which to locate the radiating surfaces of electro-acoustic drivers and passive radiators, and thereby render high quality audio output. Removable elements such as an internal battery module displace the acoustic volumes and compete for surface area of the portable loudspeaker system. High pressures within the acoustic volume also require robust and resilient seals between the drivers and/or passive radiators and the housing of the system. The examples described herein address the foregoing challenges.

Figure 1:
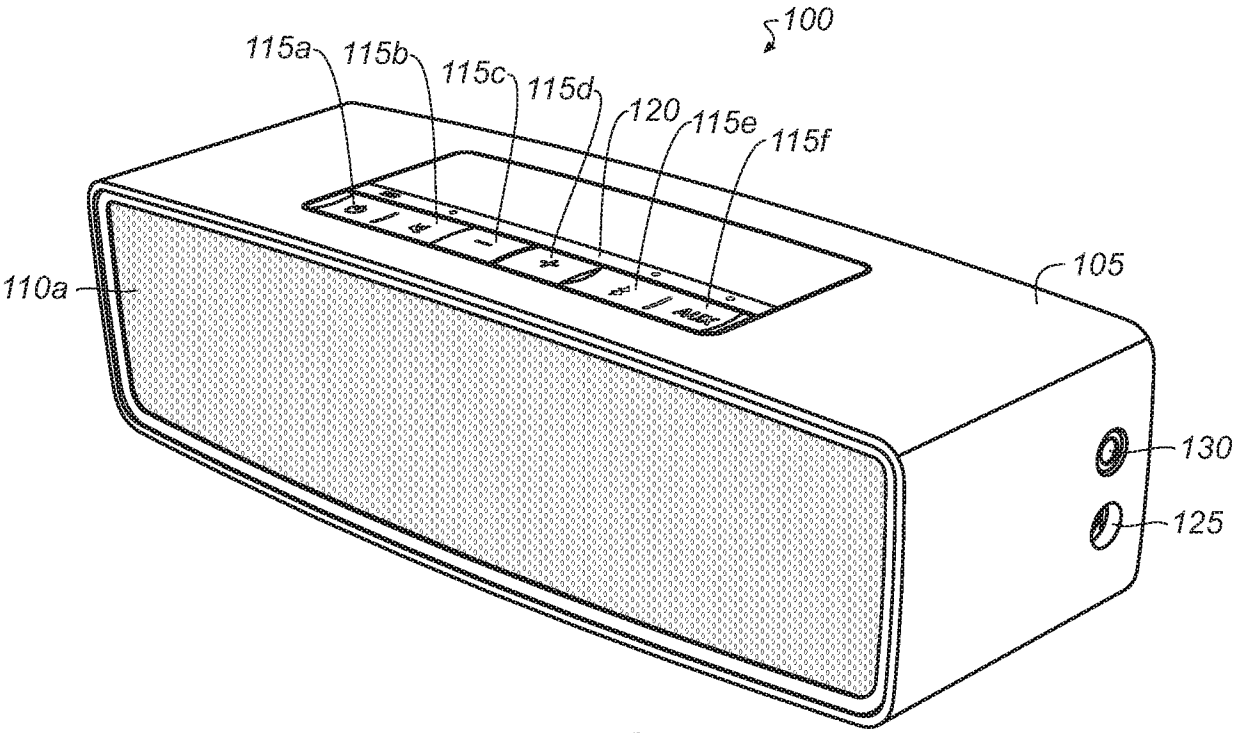
FIG. 1 is perspective view of a portable loudspeaker as seen from the front, top and right sides.

With reference to FIG. 1, a portable loudspeaker 100 includes a housing 105 and a first grille 110*a* along the front surface. In some examples, the housing is made of extruded aluminum and the first grille 110*a* is made of steel. A series of buttons 115, extend along a top surface of the loudspeaker 100 control operation of the loudspeaker. In various examples, the buttons are tact switches, manually operable control surfaces, or a series of adjacent control segments of a touch screen, for example. A "Power" button 115*a* is pressed to turn the loudspeaker 100 on or off. A "Mute" button 115*b* can be pressed to mute or un-mute the loudspeaker 100. A "Vol−" button 115*c* is pressed to decrease the volume of the loudspeaker 10. A "Vol+" button 115*d* is pressed to increase the volume of the loudspeaker 10. A "Bluetooth" button 115*e* is pressed to select a Bluetooth® audio source (not shown) which can provide an audio signal to the loudspeaker 100 via a wireless connection. The loudspeaker 100 can wirelessly receive audio signals from a Bluetooth® audio source device (not shown). In one example, the Bluetooth® button 115*e* can also be pressed for a predetermined period of time to place the loudspeaker 100 into discoverable mode for pairing with a Bluetooth® audio device. An "Aux" button 115*f* is pressed to select an auxiliary audio source (not shown) which can provide an audio signal to the loudspeaker 100 via a hardwired electrical connection. A lens 120 extends along the series of button and covers a series of iconography which illuminate to denote various operation statuses and modes of the loudspeaker 100, including for example, low battery level, paired with a Bluetooth® source. The iconography may be formed on the lens 120 using an in-molded label process (IML) in some examples. A DC-power connector 125 can be connected to a power supply (not shown) to supply power to the loudspeaker 100 or to charge a rechargeable battery (discussed below) that is secured to the housing 105. A portable audio source (not shown) can be connected to an aux in connector 130 via a 3.5-mm stereo cable in one example.

Figure 2:
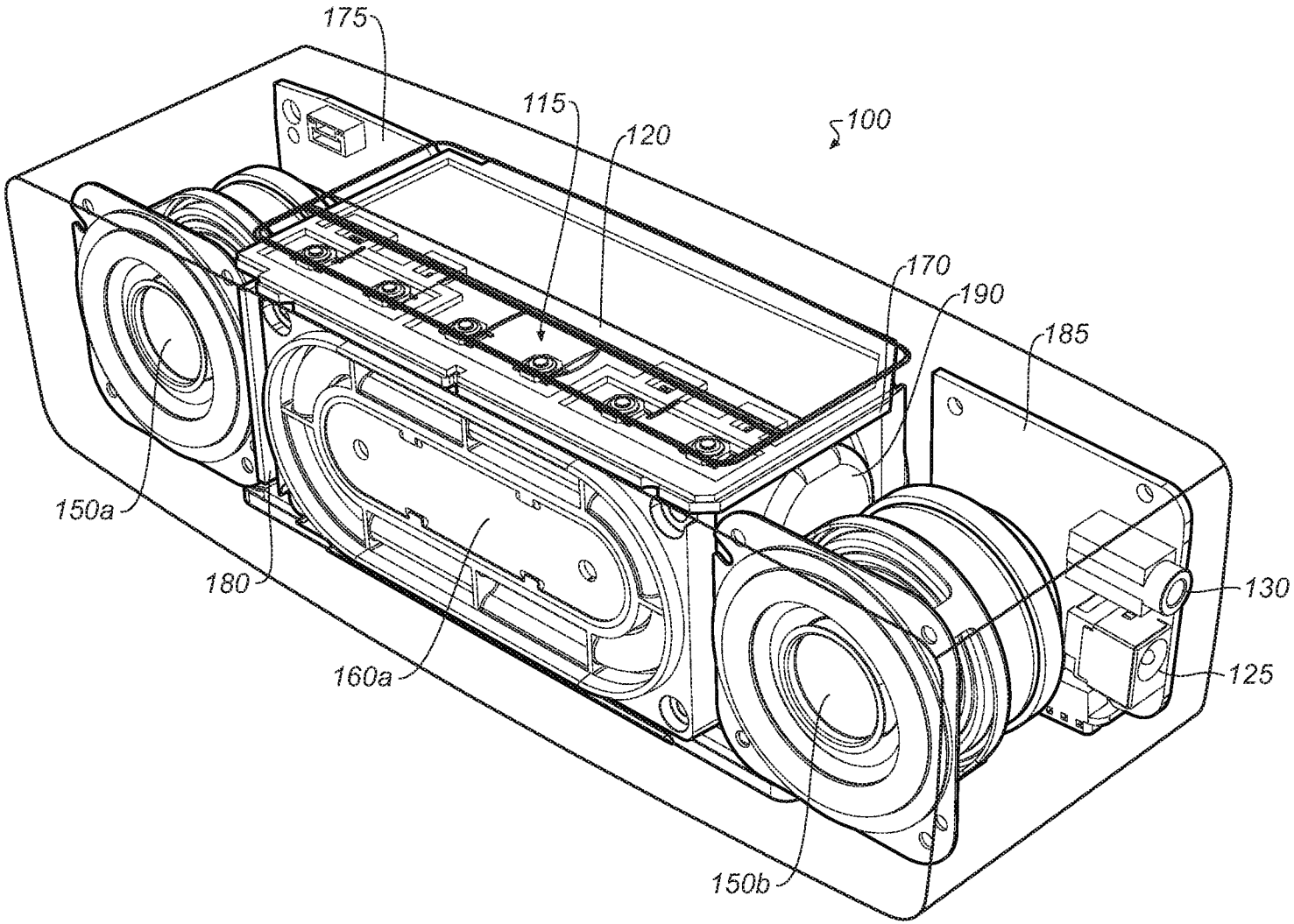
FIG. 2 is a perspective view of the portable loudspeaker of FIG. 1, with the housing shown as transparent to reveal some of the internal components of the loudspeaker.

Referring now to FIG. 2, the housing 105 is depicted transparently and the first speaker grille 110*a* is removed to show internal components of the loudspeaker 100. The loudspeaker 100 includes a first electro-acoustic driver 150*a* which is driven by a first channel audio signal and a second electro-acoustic driver 150*b* which is driven by a second channel audio signal. In one example, the first channel audio signal is a left channel audio signal and the second channel audio signal is a right channel audio signal. The drivers 150*a*, 150*b* are all secured to the housing 105 and create sound waves when operated. In one example, a first passive radiator 160*a* (sometime referred to as a "drone") is secured to the housing 105 and is located on a same side of the housing 105 as the first and second drivers 150*a*, 150*b*.

In one example, the acoustic enclosure of the loudspeaker 100 is dimensioned so that when the electro-acoustic drivers 150*a*, 150*b* are coupled to and driven by a source of audio signals, the passive radiators 160 vibrate acoustically in phase with each other and mechanically out of phase with each other.

In one example, the first and second drivers 150*a*, 150*b* are disposed on opposite ends of the housing 105, and the first passive radiator 160*a* is positioned therebetween. Each of the drivers 150*a*, 150*b* and the passive radiator 160*a* radiate acoustic energy in the same general direction. The housing 105 also contains a number of circuit boards including a main circuit board 170 which includes the series of buttons 115, an amplifier board 175 which includes an amplifier (not shown), and a boost board 180 which includes a boost converter (not shown), and an input/output board 185 which includes the DC-power connector 125 and the aux in connector 130. A removable unitary battery module 190 is disposed between the first and second drivers 150*a*, 150*b* and substantially behind the first passive radiator 160*a*.

Figure 3:
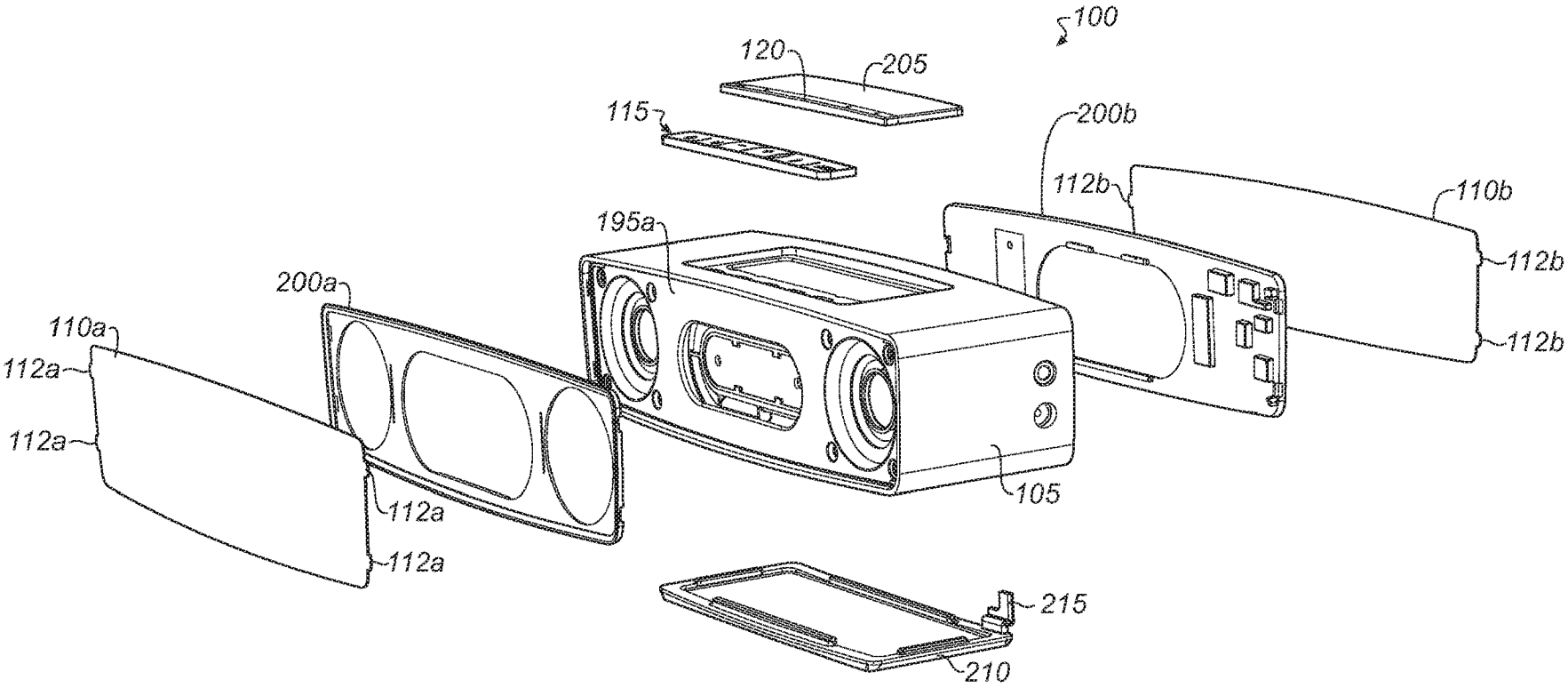
FIG. 3 is an exploded view of the portable loudspeaker of FIG. 1.
Figure 4:
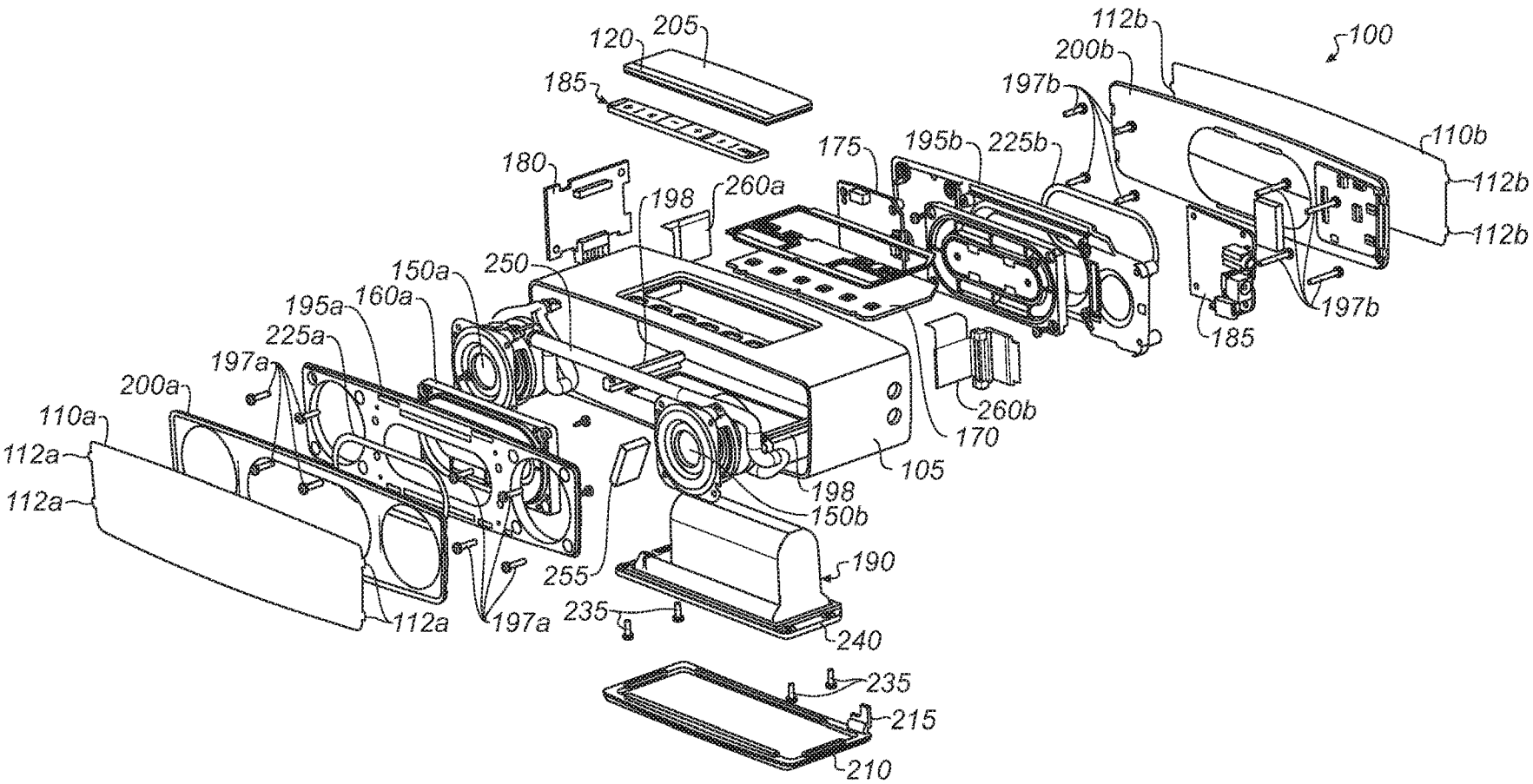
FIG. 4 is a more detailed exploded view of the portable loudspeaker of FIG. 1.

Referring now to FIGS. 3 and 4, additional components of the loudspeaker 100 are shown. A second speaker grille 110*b* of comparable size and shape to the first grille 110*a* is positioned opposite the first grille 110*a* and extends along the rear portion of the loudspeaker 100. A front baffle 195*a* attaches to a front portion of the housing 105 via a number of baffle fasteners 197*a*, such as thread-rolled hex screws for example, which attach to a series of extruded bosses 198 depending from the housing 105. The fasteners 197*a* extend through a series of holes in the first electro-acoustic drivers 150*a*, 150*b* and secure the drivers 150*a*, 150*b* to the housing 105. A rear baffle 195*b* attaches to a rear portion of the housing 105, opposite the front baffle 195*a*, via a number of baffle fasteners 197*b*, such as thread-rolled hex screws, for example, which attach to the series of extruded bosses 198 depending from the housing 105. A front speaker gasket 200*a* attaches to the front baffle 195*a* and a rear speaker gasket 200*b* attaches to the rear baffle 195*b*. The button cluster 115, the lens 120 and a lens assembly 205 are disposed in an opening in the top portion of the housing 105. A battery access door (or foot) 210 is removably attached to a bottom portion of the housing 105 to permit access, insertion and removal of the battery 190. In some examples, the door 210 remains coupled to the housing 105 via a tether 215. The access door 210 can be made of rubber, for example, and also function as a compliant, non-skid base for the loudspeaker 100 when the unit is placed upon a horizontal level surface. In some examples, the housing 105, together with the baffles 195*a*, 195*b*, the front and rear speaker gaskets 200*a*, 200*b*, the first and second drivers 150*a*, 150*b*, and the battery 190 define a substantially airtight acoustic volume within the housing 105. In one example, the acoustic volume is between 100 and 200 cubic centimeters (cc), in other examples, the acoustic volume is between 100 and 150 cc, and in still other examples, the acoustic volume is between 120 and 130 cc. In this example, the housing 105 along with the above-described components bound an internal three-dimensional acoustic volume in the approximate form of a parallelepiped. In other examples, the bounded acoustic volume is a hexahedron, a polyhedron, a cylinder, a portion of a sphere, a conic section, a prism, or other shape.

During operation of the loudspeaker 100 and in some examples, the maximum pressure of the acoustic volume (i.e., the internal box pressure) is between 0.25 and 1.5 pounds per square inch (psi), in other examples, the pressure is between 0.5 and 1.25 psi, and in still other examples, the pressure is between 0.75 and 1.0 psi. The drivers 150*a*, 150*b* acoustically energize the acoustic volume inside the loudspeaker 100 which causes the first and a second passive radiators 160*a*, 160*b* to vibrate and emit sound waves. In some examples, the vibrating surface of the first and second passive radiators 160*a*, 160*b* are substantially parallel. In some examples, a vibrating surface of the first electro-acoustic driver 150*a* and a vibrating surface of the first passive radiator 160*a* are substantially coplanar. In other examples, the vibrating surfaces of the first and second electro-acoustic drivers 150*a*, 150*b* and a vibrating surface of the first passive radiator 160*a* are all substantially coplanar.

The front and rear speaker grilles 110*a*, 110*b* are attached to the front and rear speaker gaskets 200*a*, 200*b*, respectively. In some examples, a first adhesive ring 225*a* (FIG. 4), such as a VHB pressure sensitive adhesive for example, configured to correspond to the perimeter of the first passive radiator 160*a* provides adhesion between the front grille 110*a* and the front speaker baffle 195*a*. Similarly, a second adhesive ring 225*b* (FIG. 4) configured to correspond to the perimeter of the second passive radiator 160*b* provides adhesion between the rear grille 110*b* and the rear speaker baffle 195*b*. The front and rear speaker grilles 110*a*, 110*b* are substantially acoustically transparent and provide ornamental cover and protection for the first and second transducers 150*a*, 150*b* and the first and second passive radiators 160*a*, 160*b*. The battery module 190 is removably attached to an opening in a lower portion of the housing 105 via a series of fasteners 235 which extend through a series of corresponding holes in a flange 240 extending along the base of the battery module 190. When sealed to the housing 105, the battery module 190 defines a portion of the acoustic volume, in some examples. A wiring harness 250 electrically connects various components within the housing 105. The harness 250 may be dressed with a foam layer to mitigate unwanted vibration or buzzing while the loudspeaker 100 is in operation, in some examples. In still other examples, one or more foam elements 255 can be included at various locations within the housing 105 to mitigate unwanted vibration or buzzing while the loudspeaker is in operation. Circuit board connectors 260*a* and 260*b* electrically connect the circuit boards of the loudspeaker 100. Connector 260*a* electrically connects the main board 170 with the boost board 180. Connector 260*b* electrically connects the main board 170 with the I/O board 185. The connectors 260*a*, 260*b* can be for example, flat flexible connectors or flexible PCB type connectors.

Figure 5:
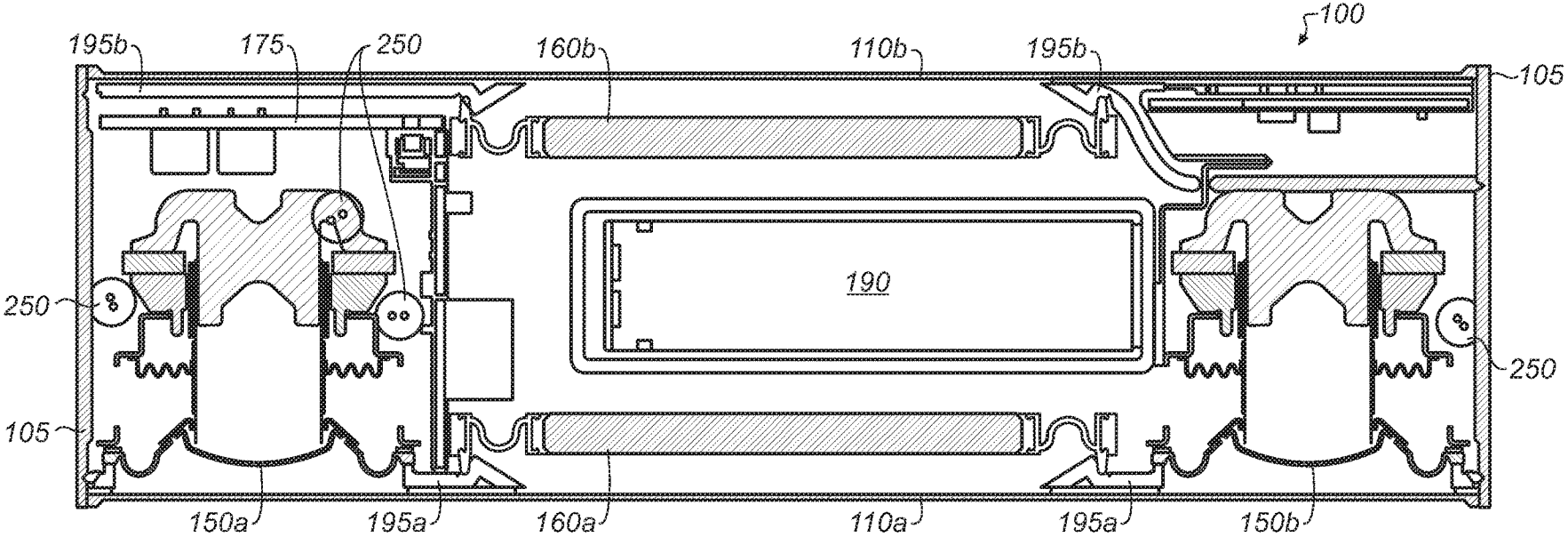
FIG. 5 a horizontal sectional view along the length of the loudspeaker of FIG. 1.
Figure 6:
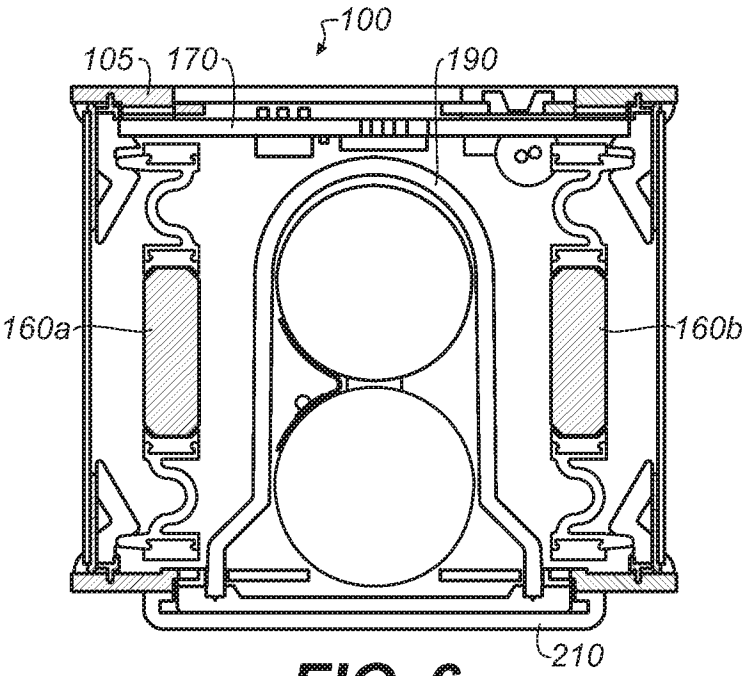
FIG. 6 is a vertical sectional view along the depth of the loudspeaker of FIG. 1.
Figure 7A:
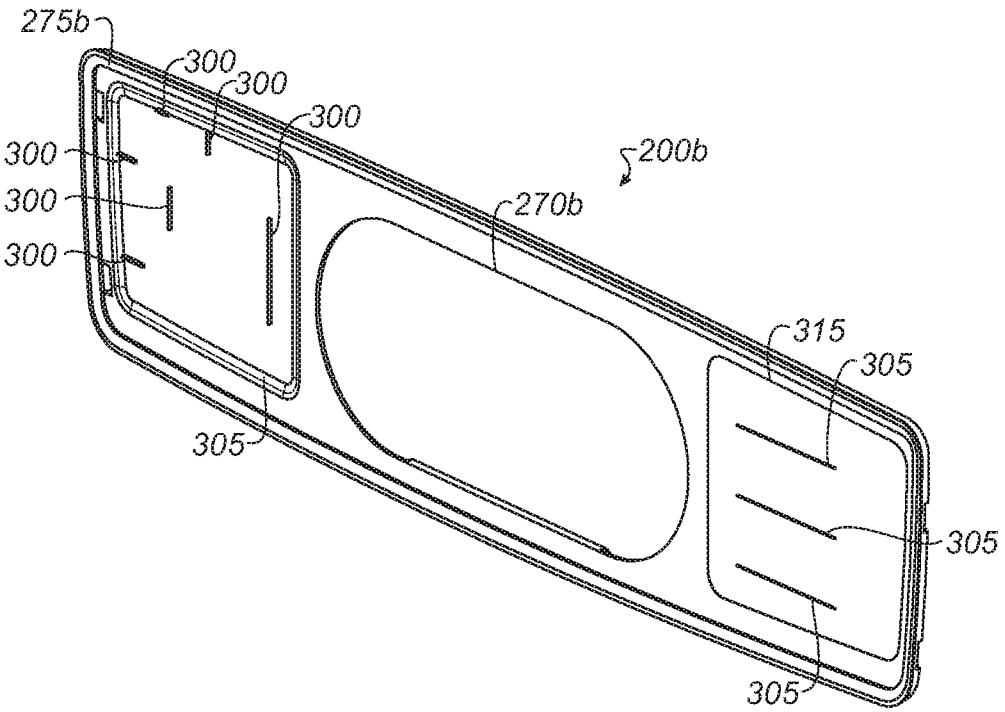
FIGS. 7A through 7G are various views of a speaker grille gasket of the loudspeaker of FIG. 1.
Figure 7B:
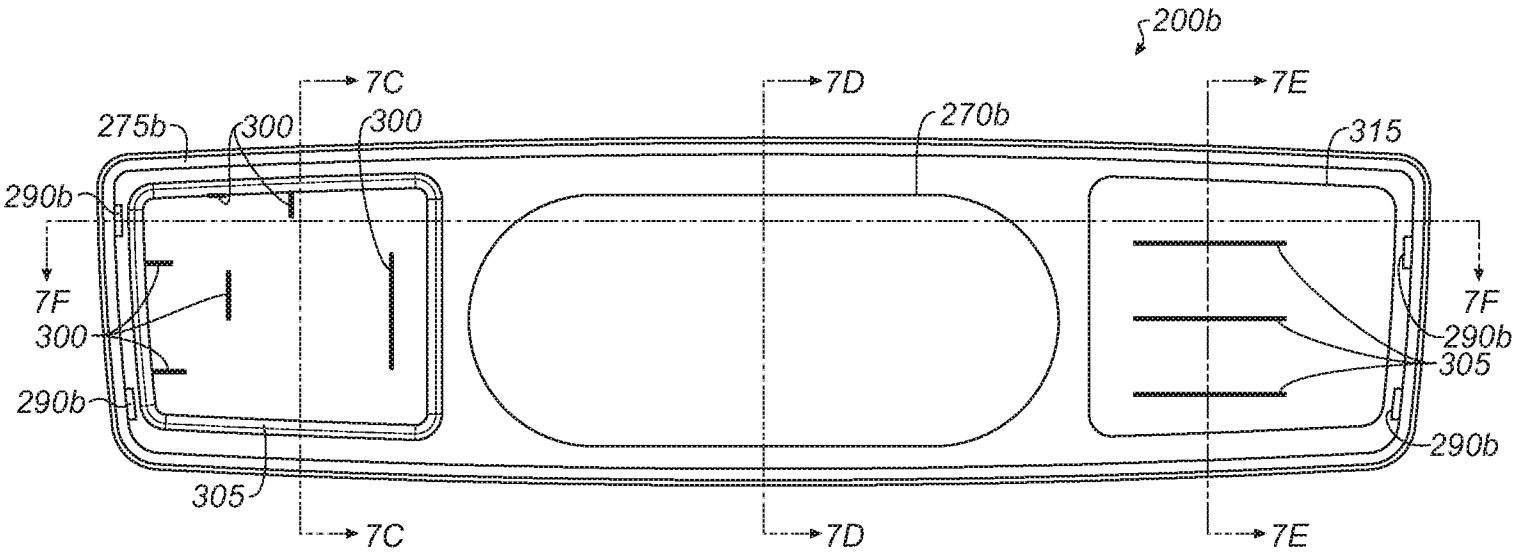
Figure 7E:
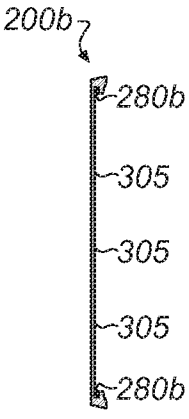
Figure 7D:
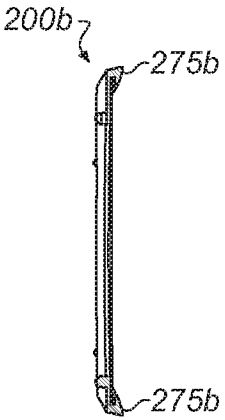
Figure 7C:
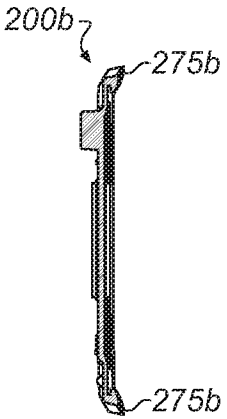
Figure 7F:
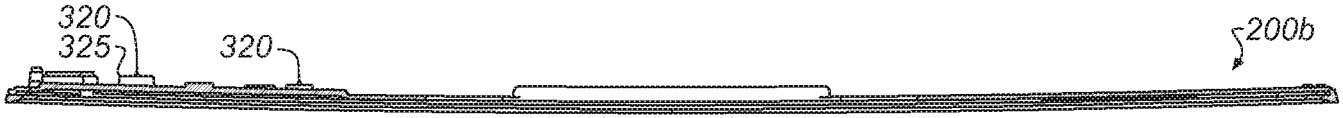
Figure 7G:
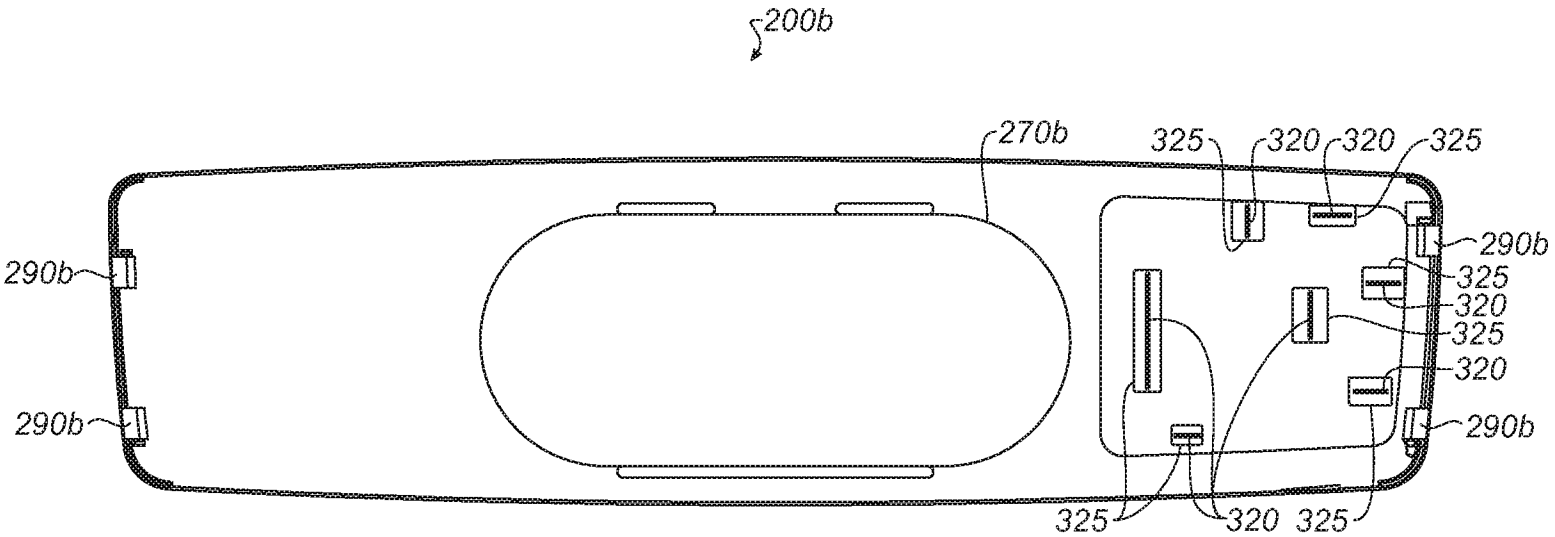

Referencing FIGS. 5 and 6, the removable unitary battery module 190 is disposed between the first and second drivers 150*a*, 150*b* and between the first and second passive radiators 160*a*, 160*b*. In some examples, the battery module 190 substantially extends from a lower portion of the housing 105 to an upper portion of the housing 105 and is located centrally between the first and second passive radiators 160*a*, 160*b*. Locating the battery module 190 between the passive radiators 160*a*, 160*b* provides a reduction in the overall size of the loudspeaker 100 for a given acoustic volume and still accommodating multiple acoustic elements such as the first and second drivers and the first and second passive radiators 160*a*, 160*b* on the housing 105.

In some examples, the passive radiators 160*a*, 160*b* are driven with parallel and preferably coaxial, directions of motion which are acoustically in phase with each other and mechanically out of phase with each other. Using two passive radiators within a single housing can be advantageous because the inertial forces associated with passive radiators may be made to cancel, and the size of each individual passive radiator may be made smaller. This is especially advantageous for small, highly portable devices, since the surface area of the housing of such devices may not be large enough to accommodate a single passive radiator.

Refer now collectively to FIGS. 7A-7G and FIGS. 8A-8D for additional details on the rear speaker gasket 200*b* and the front speaker gasket 200*a*, respectively. The speaker gaskets 200*a*, 200*b* are positioned between the speaker grilles 110*a*, 110*b* (FIGS. 3 and 4) and the front and rear speaker baffles 195*a*, 195*b* (FIG. 4), respectively and serve to minimize vibration between the grilles 110*a*, 110*b* and the baffles 195*a*, 195*b*, respectively. In some examples, the gaskets 200*a*, 200*b* may be configured to secure the front and rear speaker grilles 110*a*, 110*b* to the front and rear speaker baffle 195*a*, 195*b*.

In some examples, the gaskets 200*a*, 200*b* are made from silicone rubber, 70 durometer. Each of the gaskets 200*a*, 200*b* includes a center opening 270*a*, 270*b* to accommodate the first and second passive radiators 160*a*, 160*b*, respectively. The front speaker gasket 200*a* also includes a first driver opening 280*a* and a second driver opening 280*b* to accommodate the first electro-acoustic driver 150*a* and second electro-acoustic driver 150*b*, respectively. A front perimeter ring 275*a*, 275*b* extends along the outer perimeter and includes an undercut 280*a*, 280*b* to receive and engage the outer perimeters of the front and rear speaker grilles 110*a*, 110*b* (FIGS. 3 and 4). In some examples, slots 290*a* are located along the outer perimeter of the gasket 200*a* to receive tabs 112*a* (FIGS. 3 and 4) extending from the outer perimeter of the front speaker grille 112*a*. Similarly, slots 290*b* are located along the outer perimeter of the gasket 200*b* to receive tables 112*b* (FIGS. 3 and 4) extending from the outer perimeter of the rear speaker grille 112*b*.

In some examples, the grilles 110*a*, 110*b* are made of thin steel and include micro-perforations for acoustic transparency. The physical properties of the steel grilles 110*a*, 110*b* yields a high Q value which may result in undesirable vibratory engagement with the front and rear speaker gaskets 200*a*, 200*b*, respectively and/or with the front and rear speaker baffles 195*a*, 195*b*, respectively. This vibratory engagement between the components of the loudspeaker can lead to unwanted buzzing. To reduce or eliminate this buzzing which may otherwise be especially acute in an acoustic volume with very high internal pressures and bound by multiple components, the rear gasket 200*b* includes a first set of energy directors 300 located within a first region 305 and second set of energy directors 310 located within a second region 315. With specific reference to FIGS. 7F and 7G and in some examples, the reverse side of rear gasket 200*b* also includes energy directors 320 which extend from rectangular extrusions 325 which depend from the rear gasket 200*b* and properly position the directors 320 to engage the opposing surface of rear speaker baffle 195*b* and minimize unwanted buzzing and vibration.

Similarly, the front gasket 200*a* includes a third set of energy directors 330 and a fourth set of energy directors 335 located on opposite sides of the center opening 270*a*.

Figure 8A:
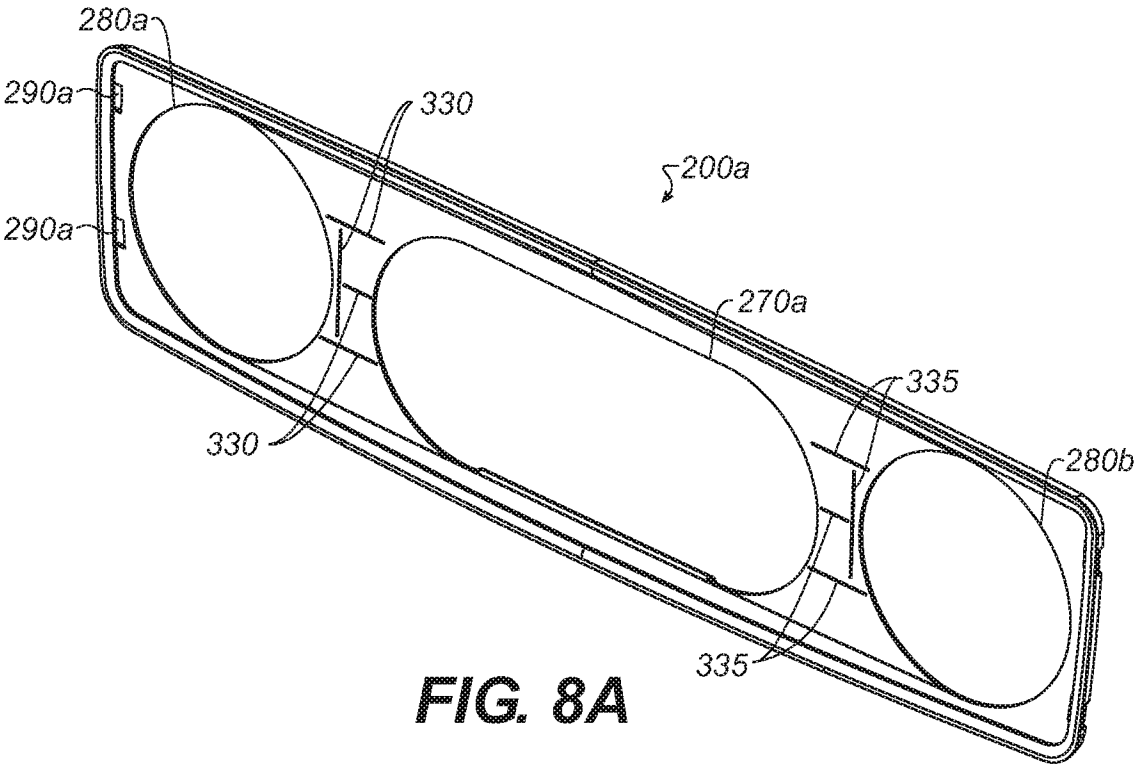
FIGS. 8A through 8E are various views of an alternative speaker grille gasket of the loudspeaker of FIG. 1.
Figure 8D:
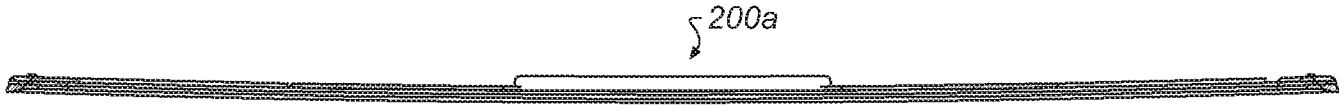
Figure 8B:
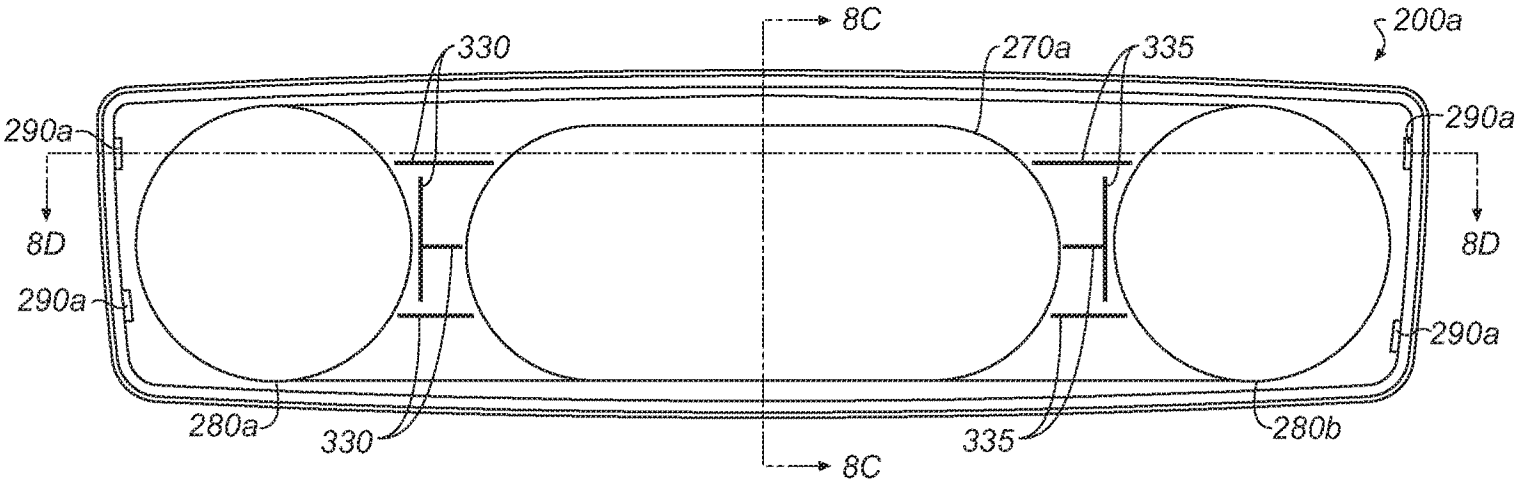
Figure 8C:
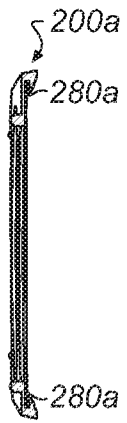
Figure 8E:
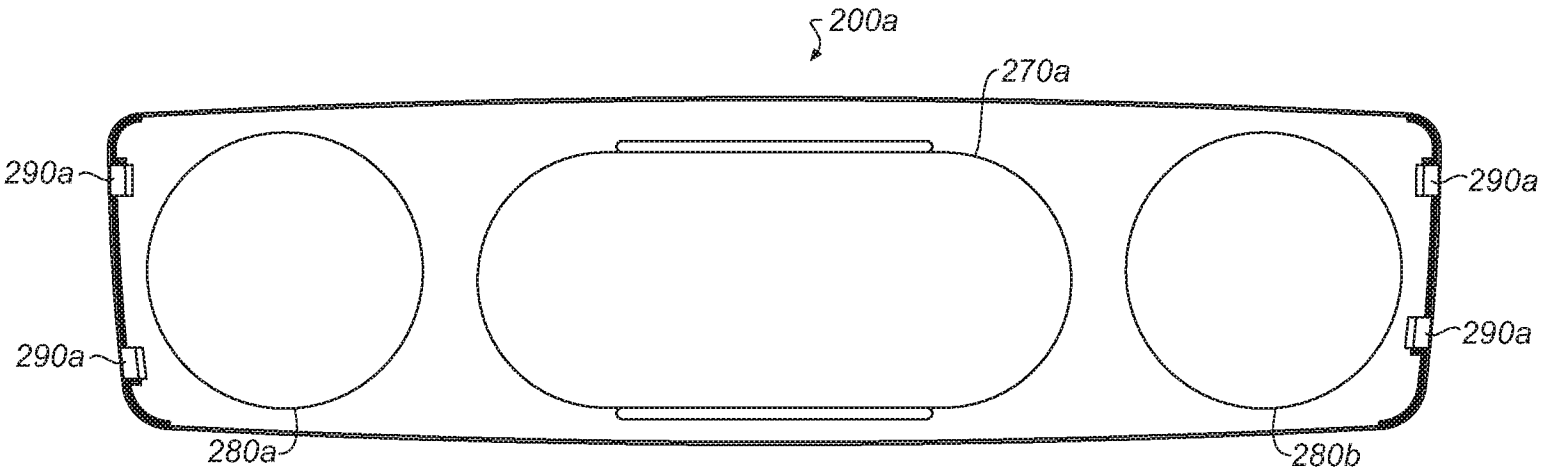

In some examples, the number, size and configuration of the energy directors 300, 305, 330, 335 correspond to the location of the features on opposing surfaces of the front and rear baffles 195*a*, 195*b*. In the example shown in FIG. 8E, the energy directors 300, 305, 330, 335 can have a triangular cross-section, but other cross sectional are contemplated including square, hemispherical, concave, and convex. Each set of energy directors 300, 305, 330, 335 can be arranged in a parallel, orthogonal, or other configuration to properly engage the opposing surfaces and minimize unwanted buzzing and vibration. In some examples, the energy directors 300, 305, 330, 335 are forced into compression by components adjacent to the baffles 195*a*, 195*b* and thereby substantially immobilize the baffles 195*a*, 195*b* to minimize buzzing.

Referring now collectively to FIGS. 9A-9F, further details of the passive radiator 160 are shown. Utilizing passive radiators is advantageous over using ported acoustic structures in some applications to augment low frequency output because passive radiators are less prone to viscous loses, to port noise, and to other losses associated with fluid flow than typical port structures. Further, passive radiators can be configured to occupy less space, which is particularly important when passive radiators are used in compact loudspeaker housing. Passive radiator 160 includes an outer frame 340 having a series of holes 345 through which certain of baffle fasteners 197*a*, 197*b* extend and engage the extruded bosses 198 of the housing 105 to secure the passive radiator 160 to the front and rear baffles 195*a*, 195*b* and to bound a portion of the acoustic volume of the loudspeaker 100. In some examples, the outer frame 340 is formed from a thermoplastic polyester engineering resin, such as polybutylene terephthalate resin, 30 percent glassfilled, sold by Celanese, 222 W. Las Colinas Blvd, Suite 900N, Irving Tex. 75039.

Figure 9A:
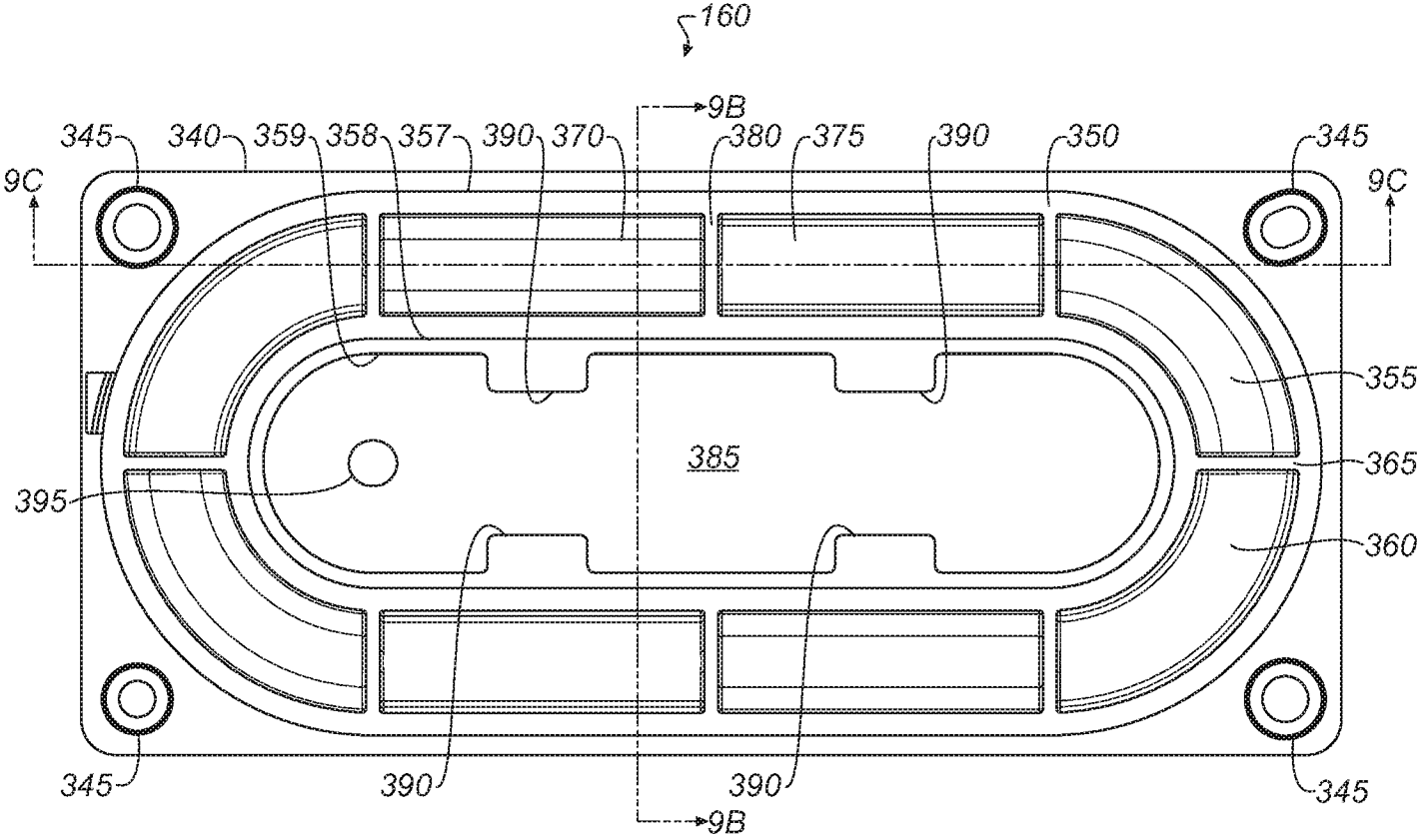
FIG. 9A through 9F are various views of a passive radiator of the loudspeaker of FIG. 1.
Figure 9C:
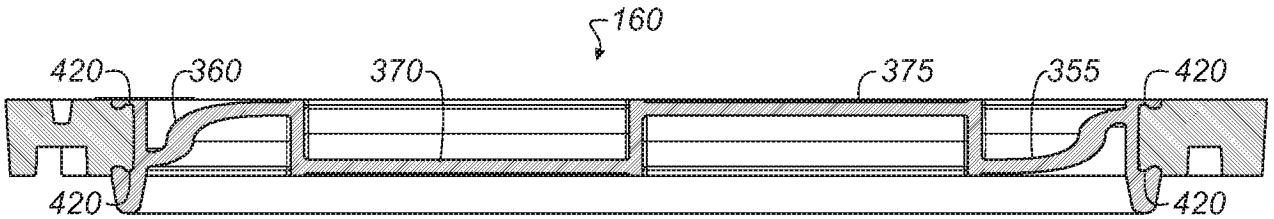
Figure 9D:
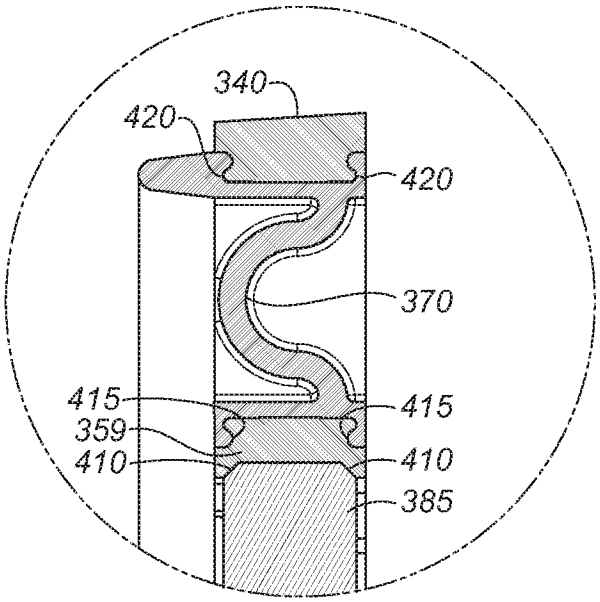
Figure 9B:
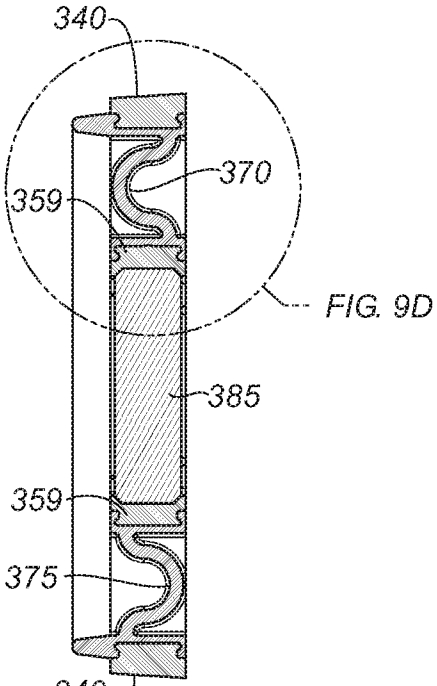
Figure 9E:
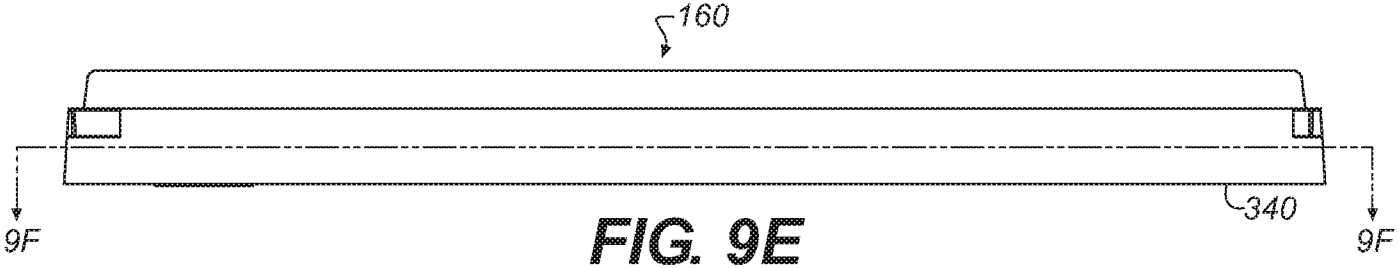

A surround 350 includes a plurality of generally planar membrane sections 355 that extend radially from an outer edge 357 connecting the frame 340 to an inner edge 358. In some examples, the membrane sections are arcuate, concave shaped (membrane section 355) and arcuate, convex shaped (membrane section 360). A radial rib 365 extends between the membrane sections 355, 360 and from the inner edge 358 to the outer edge 357 of the surround 350. The inner edge 358 of the surround 350 connects to a diaphragm (or piston) 359, which reciprocates back and forth to produce acoustic waves. The movement of the diaphragm is also referred to as excursion. When at rest, the diaphragm 359 is in a neutral position and when the diaphragm 359 is at maximum and minimum amplitude, the diaphragm can be referred to as being at maximum excursion. In some examples, the surround 350 also includes a linear, concave shaped membrane section 370 and a linear, convex shaped membrane section 375. A radial rib 380 extends between the membrane sections 370, 375 and from the inner edge 358 to the outer edge 357 of the surround 350. In some examples, the membrane sections alternate a circumferential direction from being concave membrane sections 355, 360 to convex membrane sections 360, 375. In some examples, the surround 350 is generally oval in shape and includes four linear membrane sections and four arcuate membrane sections. The diaphragm can be formed from the same materials as the frame, a polybutylene terephthalate resin as described above. In some examples, the diaphragm 359 includes a weight (or mass) 385, which is formed from a stiff material such as steel. The steel weight has a mass of between 20 and 50 grams in some examples, between 30 and 50 grams in other examples, and between 40 and 45 grams in still other examples. The steel weight 385 can be inserted molded into the diaphragm 359. As shown in FIG. 9A and in some examples, the insert molding process can include a molded cap feature 390 to reinforce the adhesion between the weight and the diaphragm 359. The weight 385 can include a blind hole 395 for retrieval and placement of the weight during the assembly process. In some examples, the inclusion of the weight 385 permits tuning of the passive radiator 160 a desired frequency range. In some examples, the passive radiator 160 of the loudspeaker 100 is tuned to a frequency range of between 60 and 100 Hz, and other examples, the passive radiator 160 is tuned to a frequency range of between 65 and 85 Hz, and in still other examples, the passive radiator is tuned to a frequency range of between 65 and 75 Hz.

Figure 9F:
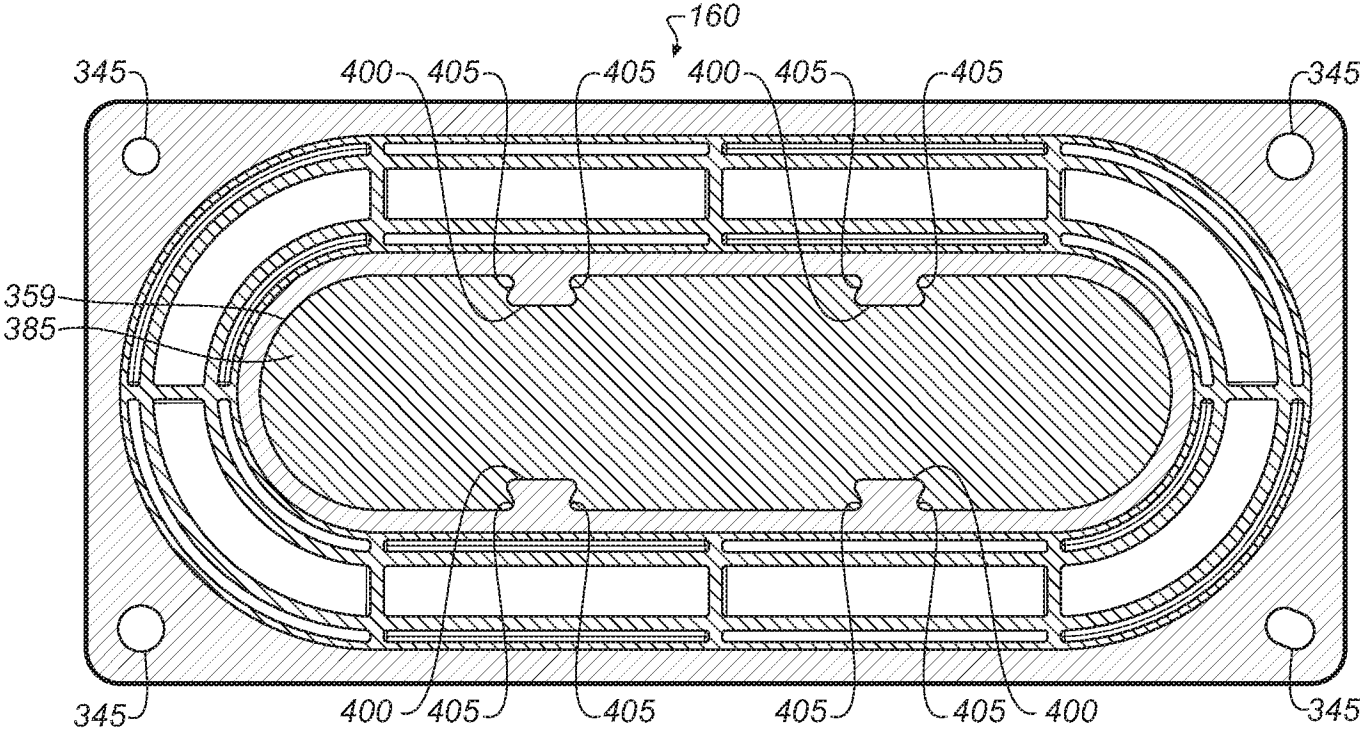

With particular reference to FIG. 9F, the weight 385 of the diaphragm 359 includes a series of notches 400 into which the molded material of the diaphragm 359 flows to form a series of dovetail joints 405 between the notches 400 of the diaphragm 359 and the weight 385. The molded cap features 390 are formed atop the dovetail joints 405 to further reinforce the adhesion between the diaphragm 359 and the weight 385. The weight 385 of the diaphragm 359 also includes a series of circumferential chamfers 410 which permit the material of the diaphragm 359 to more securely retain the weight 385 while the diaphragm is subject to reciprocal movement. A circumferential groove 415 extends along one or both sides of the diaphragm 359 and is engaged by a corresponding circumferential ridge in the surround 350 to enhance the bond between the surround 350 and the diaphragm 359. A circumferential groove 420 extends along the outer frame 340 and is engaged by a corresponding circumferential ridge in the outer edge 357 of the diaphragm 350 to enhance the bond between the surround 350 and the outer frame 340. The bonds between the weight 385 and the diaphragm 359, between the diaphragm 359 and the surround 350, and between the surround 350 and the outer frame are formed by two or three-shot injection molding processes, for example.

Figure 10:
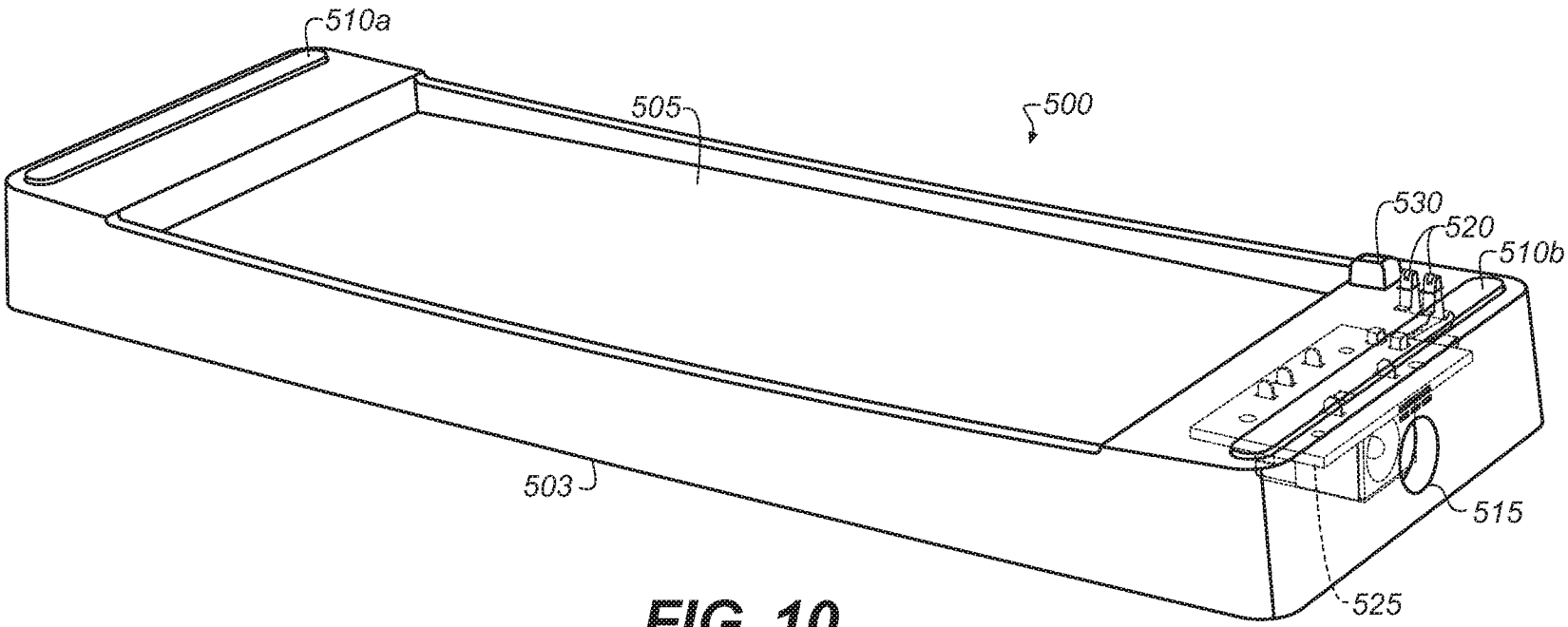
FIG. 10 is a perspective view of a charging cradle configured for use with the portable loudspeaker of FIG. 1, as seen from the front, top and right sides.

Referring now to FIG. 10, a charging cradle (or docking station) 500 is configured for coupling with the loudspeaker

100. The charging cradle 500 includes a housing 503 having a recess region 505 of the charging cradle 500 is configured to receive the lower surface of the housing 105 and accommodate the battery door 210 which can protrude from the surface of the housing 105 in some examples. Engagement strips 510*a*, 510*b* extend along the edges of the cradle 500 on opposite sides of the recess 505 and are configured to engage the lower surface of the housing 105. The strips 510*a*, 510*b* are made of a compliant material such as rubber, in some examples, to secure and stabilize the loudspeaker 100 when placed in the cradle 500. A DC-power connector 515 can be connected to a power supply (not shown) to supply power to the loudspeaker 100 or to charge the rechargeable unitary battery module 190. In some examples. The power connector 515 can accommodate the same power supply as the DC-power connector 125 (FIG. 1). Electrical contact pins 520 extend from one end of the charging cradle 500 and are configured to engage corresponding electrical contact pads (not shown) on the lower surface of the housing 105 to provide electric power to the loudspeaker 100. In some examples the contact pins 520 are spring-loaded to provide an upward bias toward the contact pads on the housing 105 to establish and maintain physical contact between the opposing contact pins 520 and the contact pads. The contact pins 520 are located on an input/output board 525 (shown in phantom) inside the housing 503. An alignment pin 530 extends upward from the housing 503 is configured to engage with a corresponding recess (not shown) in the lower surface of the housing 105 of the loudspeaker to ensure that the contact pins 520 are seated properly against the contact pads of the housing 105 when the loudspeaker is placed upon the charging cradle 500. In some examples, multiple alignment pins 530 may be used, on the same or opposite ends of the housing 503 to engage corresponding recesses (not shown) in the lower surface of the housing 105.

A number of implementations have been described. Nevertheless, it will be understood that additional modifications may be made without departing from the spirit and scope of the inventive concepts described herein, and, accordingly, other embodiments are within the scope of the following claims.

What is claimed is:

1. A loudspeaker comprising:

a first electro-acoustic driver which creates sound waves when operated;

a housing;

a first baffle coupled to the housing and the first electro-acoustic driver;

a first speaker grille covering the first electro-acoustic driver;

a first gasket disposed between the first baffle and the first speaker grille, wherein the first gasket comprises a first set of energy directors to reduce buzzing between the first gasket and the first baffle;

a first passive radiator mounted to the first baffle, wherein sound waves from the first electro-acoustic driver acoustically energize the first passive radiator; and a second electro-acoustic driver coupled to the housing and the first baffle, wherein both the first and second electro-acoustic drivers are located on either side of the first passive radiator, and wherein the first gasket defines a first driver opening and a second driver opening to accommodate the first and second electro-acoustic drivers, respectively.

2. The loudspeaker of claim 1, wherein the first set of energy directors are disposed on a first side of the first gasket and extend toward the housing.

3. The loudspeaker of claim 2, wherein the first gasket comprises a second set of energy directors on a second side of the first gasket opposite the first side.

4. The loudspeaker of claim 1, further comprising a second baffle coupled to the housing, opposite the first baffle; a second passive radiator coupled to the second baffle; a second speaker grille covering the second passive radiator; and a second gasket disposed between the second baffle and the second speaker grille, wherein the second gasket comprises a second set of energy directors to reduce buzzing between the second gasket and the second baffle.

5. The loudspeaker of claim 4, further comprising a unitary battery module secured to the housing and extending into a region directly between the first and second passive radiators, the battery providing electrical power to the first electro-acoustic driver, the sound waves from the first electro-acoustic driver being capable of acoustically energizing the first and second passive radiators.

6. The loudspeaker of claim 4, wherein the second gasket further comprises a third set of energy directors to reduce buzzing between the second gasket and the second speaker grille.

7. The loudspeaker of claim 4, wherein the number, size, and configuration of the first and second sets of energy directors correspond to the location of features on opposing surfaces of the first and second baffles, respectively.

8. The loudspeaker of claim 4, wherein the first and second sets of energy directors are forced into compression by components adjacent to the first and second baffles, respectively, and thereby substantially immobilize the first and second baffles to reduce buzzing.

9. The loudspeaker of claim 4, wherein the first and second gaskets are made from silicone rubber.

10. The loudspeaker of claim 4, wherein each of the first and second gaskets includes a center opening to accommodate the first and second passive radiators, respectively.

11. The loudspeaker of claim 4, wherein each of the first and second gaskets includes a perimeter ring to receive and engage respective outer perimeters of the first and second speaker grilles.

12. The loudspeaker of claim 4, wherein each of the first and second speaker grilles comprise tabs, and wherein the first and second gaskets define slots to receive the tabs.

13. The loudspeaker of claim 1, wherein the first set of energy directors include at least one of a triangular, square, hemispherical, concave, or convex cross-section.

14. The loudspeaker of claim 1, wherein the first set of energy directors are arranged in a parallel or orthogonal configuration.

15. A portable loudspeaker, comprising:

a first electro-acoustic driver which creates sound waves when operated;

a housing having a first side to which the first electro-acoustic driver is secured, and a second side opposite the first side;

a first passive radiator secured to the first side of the housing and a second passive radiator secured to the second side of the housing, each of the first and second passive radiators comprising a frame, a surround, and a diaphragm that is coupled to the frame via the surround;

a second electro-acoustic driver coupled to the housing, wherein both the first and second electro-acoustic drivers are located on either side of the first passive radiator;

a unitary battery module secured to the housing and extending into a region directly between the first and second passive radiators, the battery module providing electrical power to the driver, the sound waves from the driver being capable of acoustically energizing the first and second passive radiators, wherein the battery module is disposed centrally between the first and second passive radiators; and a first gasket defining a first driver opening and a second driver opening to accommodate the first and second electro-acoustic drivers, respectively.

16. The portable loudspeaker of claim 15, further comprising a second electro-acoustic transducer secured to the first side of the housing, where both the first and second electro-acoustic drivers are located on either side of the first passive radiator.

17. The portable loudspeaker of claim 15, wherein the battery module extends into the housing along a plane that is parallel to the diaphragm of the first passive radiator.

18. The portable loudspeaker of claim 15, wherein the maximum excursion of at least one of the passive radiators traverses substantially all of the distance between that passive radiator and the battery module.

19. The portable loudspeaker of claim 15, wherein the respective surrounds of the first and second passive radiators each comprise first and second membrane sections, the first membrane section comprising a concave cross-section and the second membrane section comprising a convex cross-section.

20. The portable loudspeaker of claim 15, wherein the first and second passive radiators vibrate acoustically in phase with each other and mechanically out of phase with each other.

21. The portable loudspeaker of claim 15, wherein the housing comprises extruded aluminum having a first extruded opening to receive the first and second electro-acoustic drivers and the first passive radiator, and a second extruded opening opposite the first extruded opening to receive the second passive radiator.

22. The portable loudspeaker of claim 15, wherein each of the first and second passive radiators further comprise a mass and a molded portion that extends along an edge of the mass, wherein the molded portion is coupled to the surround.

23. The portable loudspeaker of claim 22, wherein the mass includes a notch which the molded portion engages to form a dovetail joint.

24. The portable loudspeaker of claim 22, wherein the mass further comprises a series of chamfers which permit the molded portion to more securely retain the mass while the diaphragm is subject to reciprocal movement.

25. The portable loudspeaker of claim 22, wherein the mass defines a blind hole for retrieval and placement of the mass during assembly.

26. The portable loudspeaker of claim 22, wherein the molded portion includes a first groove and wherein the surround comprises a first ridge that engages the first groove.

* * * * *